US005357086A

United States Patent [19]

Turpin et al.

[11] Patent Number: 5,357,086

[45] Date of Patent: Oct. 18, 1994

[54] MICROWAVE CORN POPPING PACKAGE

[75] Inventors: Charles H. Turpin, Minneapolis; James W. Montealegre, Shoreview, both of Minn.

[73] Assignee: Golden Valley Microwave Foods Inc., Edina, Minn.

[21] Appl. No.: 25,010

[22] Filed: Mar. 15, 1993

Related U.S. Application Data

[63] Continuation-in-part of Ser. No. 959,681, Oct. 13, 1992, which is a continuation-in-part of Ser. No. 852,291, Mar. 16, 1992, abandoned.

[51] Int. Cl.[5] ..... H05B 6/80

[52] U.S. Cl. ..... 219/732; 219/725; 99/DIG. 14; 426/113; 426/107; 426/234; 426/243

[58] Field of Search ..... 219/10.55 E, 10.55 F, 219/10.55 M, 725, 730, 731, 732, 734, 735; 426/113, 107, 234, 243; 99/DIG. 14

[56] References Cited

U.S. PATENT DOCUMENTS

| | | | |
|---|---|---|---|
| 1,944,089 | 1/1934 | Litchfield | 158/9 |
| 3,357,152 | 12/1967 | Geigel | 53/29 |
| 3,851,574 | 12/1974 | Katz et al. | 426/107 |
| 3,973,045 | 8/1976 | Brandberg et al. | 426/110 |
| 4,038,425 | 7/1977 | Brandberg et al. | 426/107 |
| 4,219,573 | 8/1980 | Borek | 426/107 |
| 4,228,945 | 10/1980 | Wysocki | 229/30 |
| 4,283,427 | 8/1981 | Winters et al. | 426/107 |
| 4,345,133 | 8/1982 | Cherney et al. | 219/10.55 E |
| 4,355,757 | 10/1982 | Roccaforte | 229/33 |
| 4,450,180 | 5/1984 | Watkins | 426/107 |
| 4,453,665 | 6/1984 | Roccaforte et al. | 229/41 B |
| 4,477,705 | 10/1984 | Danley et al. | 219/10.55 E |
| 4,555,605 | 11/1985 | Brown et al. | 219/10.55 E |
| 4,584,202 | 4/1986 | Roccaforte | 426/111 |
| 4,586,649 | 5/1986 | Webinger | 426/111 |
| 4,612,431 | 9/1986 | Brown et al. | 219/10.55 E |
| 4,642,434 | 2/1987 | Cox et al. | 219/10.55 E |
| 4,661,672 | 4/1987 | Nakanaga | 219/10.55 E |
| 4,698,472 | 10/1987 | Cox et al. | 219/10.55 E |
| 4,703,148 | 10/1987 | Mikulski et al. | 219/10.55 E |
| 4,727,706 | 3/1988 | Beer | 53/434 |
| 4,735,513 | 4/1988 | Watkins et al. | 383/116 |
| 4,794,005 | 12/1988 | Swiontek | 426/107 |
| 4,896,009 | 1/1990 | Powlowski | 219/10.55 E |
| 4,904,488 | 2/1990 | LaBaw et al. | 426/107 |
| 4,948,932 | 8/1990 | Clough | 219/10.55 E |
| 4,959,516 | 9/1990 | Tigne et al. | 219/10.55 E |
| 4,973,810 | 11/1990 | Brauner | 219/10.55 E |
| 4,982,064 | 1/1991 | Hartman et al. | 219/10.55 E |
| 5,008,024 | 4/1991 | Watkins | 219/10.55 E |
| 5,011,299 | 4/1991 | Black, Jr. et al. | 383/126 |
| 5,044,777 | 9/1991 | Watkins et al. | 383/100 |
| 5,081,330 | 1/1992 | Brandberg et al. | 219/10.55 E |
| 5,095,186 | 3/1992 | Russell et al. | 219/10.55 E |
| 5,097,107 | 3/1992 | Watkins et al. | 219/10.55 E |
| 5,153,402 | 10/1992 | Quick et al. | 219/10.55 E |
| 5,195,829 | 3/1993 | Watkins et al. | 383/100 |
| 5,200,590 | 4/1993 | Bowen et al. | 219/10.55 E |

*Primary Examiner*—Bruce A. Reynolds
*Assistant Examiner*—Tu Hoang
*Attorney, Agent, or Firm*—James V. Harmon

[57] ABSTRACT

A collapsed flexible, e.g., paper, bag is provided which contains a charge of unpopped popcorn. Popping of the corn can be carried out in a microwave oven with the bag supported upon a pre-erected or collapsible stand, usually about 2 cm high, attached to the bag. The bag includes upper and lower opposing face panels connected together by longitudinally extending, centrally projecting gussets that are integral with the face panels. Prior to popping, the gussets are folded between the under and lower face panels of the bag and the bag is sealed at each end. A microwave heating susceptor is provided in the lower panel of the bag or elsewhere in the bag if desired. During popping of the popcorn kernels, the bag increases in size and the gussets expand outwardly as the bag becomes filled with popped kernels, hot vapor and steam. In certain microwave ovens the stand is erected to elevate the bag so that microwave energy will transfer well to the popcorn, causing the popcorn to pop efficiently, and in other ovens the corn pops best with the stand collapsed. One form of stand is capable of being folded flat, i.e., collapsed for shipment and storage. In an alternative modified form of the invention, the stand is an initially detached, pre-erected tray-shaped stand. During microwave cooking, a heat-activated adhesive bonds the tray-shaped stand to the bag.

14 Claims, 6 Drawing Sheets

MICROWAVE CORN POPPING PACKAGE

This is a continuation-in-part of prior application Ser. No. 07/959,681, filed Oct. 13, 1992, which is a continuation-in-part of application Ser. No. 852,291, filed Mar. 16, 1992 (now abandoned).

FIELD OF THE INVENTION

This invention relates to a microwave corn popping package.

BACKGROUND OF THE INVENTION

At the time microwave popcorn was first commercialized, microwave popcorn bags were sized to be the largest size that would fit in the most commonly available ovens in use at the time. A de facto standard size of about 100 grams resulted. This size has come to be preferred by microwave popcorn customers, with sizes larger, and especially smaller, being much less acceptable as shown by relative sales volume.

This size fits and works well in most of today's microwave ovens. However, there is one class of oven where this size does not work well—and that is the class of oven wherein a turntable is used to enhance uniformity of heating. In such ovens, if the 100 gram bag is too close to the maximum space capacity of the oven, the bag can catch or hang up and so no longer rotate, thus inactivating the uniformity of heating feature of the oven turntable, resulting in reduced pop volume and sometimes even scorching. Such small ovens may often have a turntable of about 23 cm or less in diameter and are very common in some markets, making it unfeasible to market the most popular bag size in those markets. In fact, the largest de facto standard size that will fit these ovens is the 50 gram size, which uses a bag having a height of only about 23 cm and a width of about 10 cm across each face.

Another problem in certain microwave ovens is that the area of maximum field intensity is in an unusual position owing to the design of the oven cavity or the presence of a metal cooking surface. For example, in a typical Japanese oven it has been found that the maximum field intensity is not located at or immediately above the support surface within the oven as it is in typical U.S. ovens. Japanese ovens are characterized by the presence of a metal cooking surface, i.e., a metal support surface such as a turntable for the food at the bottom of the oven compartment. Foods like popcorn which depend on an electric field powered susceptor in the bottom of a paper container, e.g., a bag, are not heated very well in ovens of this kind. As a result, the popcorn pops slowly, and very often popping is incomplete, resulting in a large number of unpopped kernels which consumers find unacceptable. In addition, heating may be spotty, causing popcorn in some parts of the bag to burn or kernels in other portions of the package remain unpopped. This is a particularly serious problem to the consumer who often perceives the packaged popcorn as a poor product and may never buy it again. By contrast, other ovens such as those commonly marketed in the United States exhibit a maximum microwave field intensity that is positioned very close to the cooking surface (the oven floor), e.g., about one-sixteenth to about one-eighth inch above the cooking surface so that the microwave energy is transmitted very efficiently to the susceptor of a packaged food product resting directly on the floor of the oven.

A major objective of the present invention is to provide an improved microwave popcorn popping package in which energy can be transmitted efficiently to the susceptor in both of the above types of ovens. Another objective is to find a way of mass producing an inexpensive disposable paper bag that can be placed selectively in either of two or more positions within the microwave oven to assure popping at maximum efficiency. Another more specific object is to provide an inexpensive popcorn bag that can be mass produced efficiently and in which cooking can be carried out in either a raised or a lowered position.

Attempts were made by us to develop a pre-erected stand which was separate, i.e., detached from the popcorn bag but initially such attempts resulted in failure, partly because the bag would sometimes fall off the stand as the package rotated on the turntable within a microwave oven. In addition, a pre-erected stand can take up a good deal of additional space in a package.

It is therefore a further object to provide a popcorn bag with a stand that does not have to be folded or otherwise manipulated to prepare it for use. Another object is to provide a pre-erected stand which has a space-saving feature. A further, more specific object is to find a way of providing a detached stand that occupies little additional spaced and still will not allow the bag to be dislodged; i.e., knocked off the stand due to the rotation of the oven turntable on which the stand is placed during cooking in a microwave oven.

These and other more detailed and specific objects of the invention will be better understood by reference to the following detailed description and figures which illustrate by way of example but a few of the various forms of the invention within the scope of the appended claims.

SUMMARY OF THE INVENTION

Briefly, for the purpose of popping popcorn in a microwave oven, the present invention provides a flexible bag containing popcorn and having a collapsible stand as a part of the bag. The bag includes upper and lower face panels defining the major faces of the bag. Connected to and extending between the faces of the bag are left and right longitudinally extending, centrally projecting gussets that are integral with the face panels. Prior to popping, the gussets are folded between the upper and lower face panels of the bag. The panels and gussets are preferably formed from a pair of superimposed sheets of paper that are laminated together with adhesive. Popcorn is placed in the bag and the ends of the bag are sealed. A microwave heating susceptor of any suitable type is provided in the lower panel of the bag. If desired, the bag ends can be cut in an arcuate configuration, either as a continuously curved convex arc or as several straight adjoining cut segments. Popping of the corn can be carried out in a microwave oven with the bag supported upon a pre-erected or collapsible stand, usually about 2 cm high, attached to the bag. In certain ovens this stand is erected to elevate the bag so that microwave energy will transfer well to the popcorn, causing the popcorn to pop efficiently. One form of stand is capable of being folded flat, i.e., collapsed for shipment and storage. In an alternative modified form of the invention, the stand is an initially detached pre-erected tray-shaped stand. During microwave cooking a heat-activated adhesive bonds the tray-shaped stand to the bag.

During popping of the popcorn kernels, the bag increases in size and as this happens, gussets expand outwardly as the bag becomes filled with popped kernels, hot vapor and steam.

THE FIGURES

DETAILED DESCRIPTION OF THE INVENTION

Figure 1:
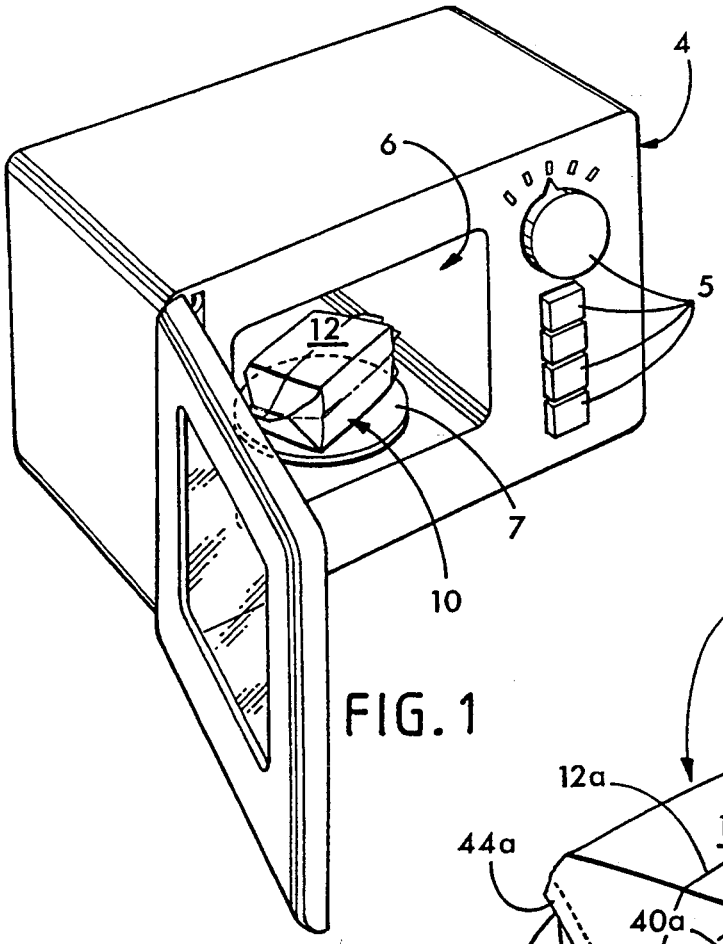
FIG. 1 is a perspective view of a microwave oven holding a bag in accordance with the invention as it appears just after popping.

Refer now to the figures. Shown in FIG. 1 is a microwave oven 4 having the usual controls 5 and an oven cooking chamber 6 provided with a rotatable turntable 7 upon which is placed a popcorn bag 10 embodying one alternative form of the invention. In FIGS. 1, 2, 4 and 5 the popcorn bag 10 is shown as it appears in the expanded condition during and immediately after popping.

The bag 10 is composed of flexible microwave transparent sheet material, preferably of a pair of paper plies **10*a* and 10*b* (FIG. 2) that are superimposed and sealed together by means of adhesive, i.e., laminated to one another to form a composite structure. The composition of the bag 10**, adhesives used, and its mode of assembly, etc., can be as described in any of the following patents which are incorporated herein by reference: U.S. Pat. Nos. 4,691,374; 4,735,513; 4,878,765; 4,450,180; 5,044,777 or 5,081,330.

The bag 10 includes a flat upper face panel 12 and a flat lower face panel 14. The upper face panel 12 is provided with a longitudinally extending, adhesively bonded seam **12*a* that bonds the edges of the cut sheet from which the bag is formed together along the length of the bag. Extending longitudinally of the bag 10 between the face panels 12, 14 are a pair of longitudinally extending, centrally projecting folded gussets 16 and 18 which are integral with face panels 12 and 14**.

Within the bag 10 is a charge 13 of popcorn, preferably together with a quantity of shortening. Bonded between the plies **10*a*, 10*b* beneath the charge 13 of popcorn and shortening is a susceptor 14*b*. While any suitable type of susceptor known to the art can be employed, the susceptor 14*b*** preferably comprises a thin sheet of plastic such as 0.5 mil polyethylene terephthalate having a thin semiconductive coating of metal, e.g., aluminum, vacuum electrodeposited thereon for absorbing microwave energy and converting it to heat.

Figure 2:
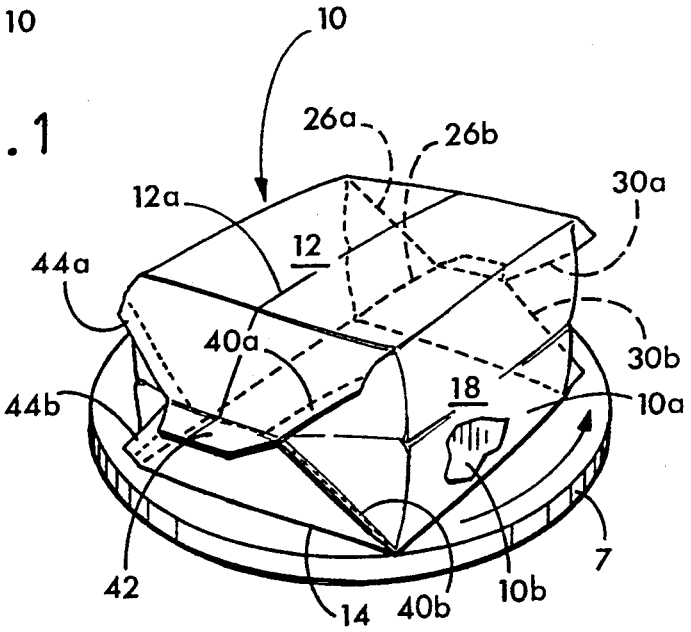
FIG. 2 is an enlarged perspective view of the turntable and popcorn bag illustrated in FIG. 1 as it appears after it has been fully inflated and the corn has been popped.
Figure 3:
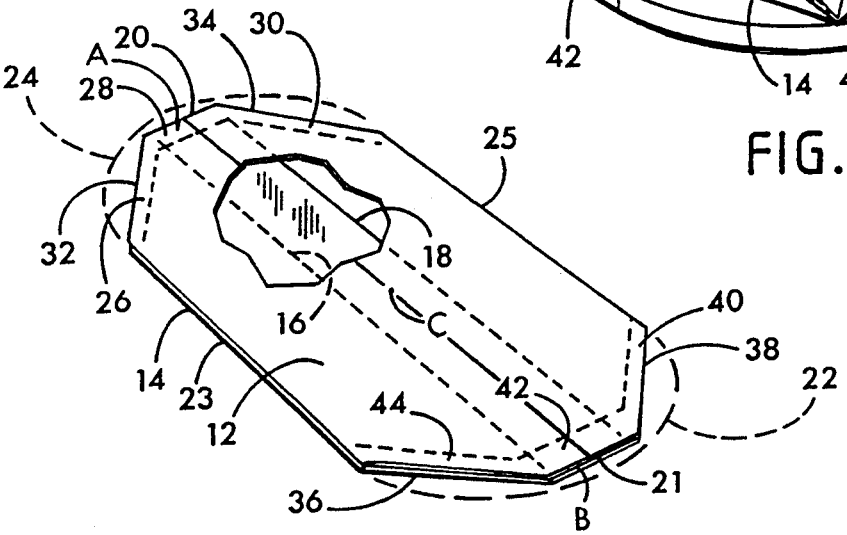
FIG. 3 is a perspective view of the package in a collapsed condition as it appears prior to popping of the corn.

The ends of the optional form of the bag 10 shown in FIGS. 1–5 are cut in a particular way. Other embodiments to be described below have straight cut ends. As shown in FIG. 3, the bag 10 is provided with a top end A and a bottom end B. The top end A is provided with an arcuate cut edge which can, if desired, either be in the form of a continuously curved convex arc 22 or, as shown in the figure, composed of several straight adjoining cut segments, in this case a straight center segment 20 and inclined cut segments 31 and 32 proceeding outwardly and downwardly from the central centermost segment 20. The top end A of the bag 10 is glued together by means of three adhesive strips 26, 28 and 30 which are aligned with the cut edges 32, 20 and 31, respectively.

Similarly, the bottom end B of the bag 10 is provided with an arcuately contoured cut end composed of three straight segments 36, 21 and 38 joined end-to-end to form a convex arc. The panels and gussets are bonded together by means of an arcuate line of adhesive composed of segments 40, 42 and 44 aligned with the cut edges 38, 21 and 36, respectively. Similarly, the contoured arcuate bottom cut end B of the bag can be a continuously curved arc as shown at 24, if desired, rather than being formed of several connected straight segments. The arcuate cut ends A and B of the bag 10 both have a convex shape with respect to the center of the bag and can, if desired, form a convex arc such as a circular or elliptical arc about the center point C of the bag 10.

By viewing FIG. 2, it will be seen that the adhesive line 40 consists of a pair of adhesive bonds **40*a* and 40*b* between the gusset fold 18 in the upper and lower face panels 12 and 14. Similarly, the adhesive line 44 includes an upper segment 44*a* and a lower segment 44*b* which bond the gusset 16 and the upper and lower face panels. The adhesive line 42 bonds the face panels 12 and 14 between the gusset folds 16 and 18**.

Refer now to FIG. 3 which illustrates clearly how the gussets are cut in the embodiment of FIGS. 1–5. It will be seen that the height of each of the gussets 16 and 18 is greatest near the center of the bag but diminishes proceeding laterally toward the side edges 23 and 25 of the bag 10. The gusset will thus have a generally trapezoidal configuration prior to popping when the bag is flat as in FIG. 3. Each end of each gusset 16, 18 is securely bonded to the adjacent face panels 12, 14 by means of the lines of adhesive 26*a*, 26*b*, 30*a*, 30*b*, at the top of the bag and 40*a*, 40*b*, 44*a*, 44*b* at the bottom of the bag.

Figure 4:
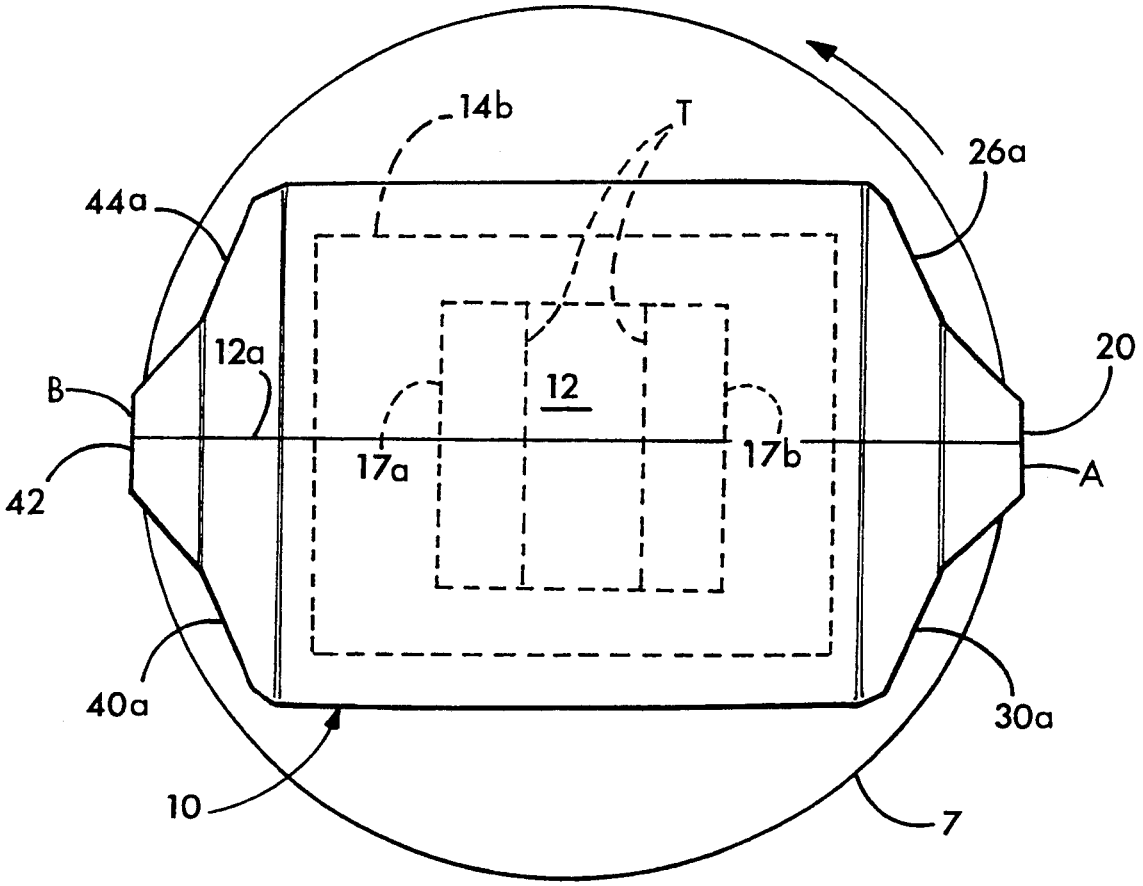
FIG. 4 is a top view of the package of FIG. 2 after popping.
Figure 5:
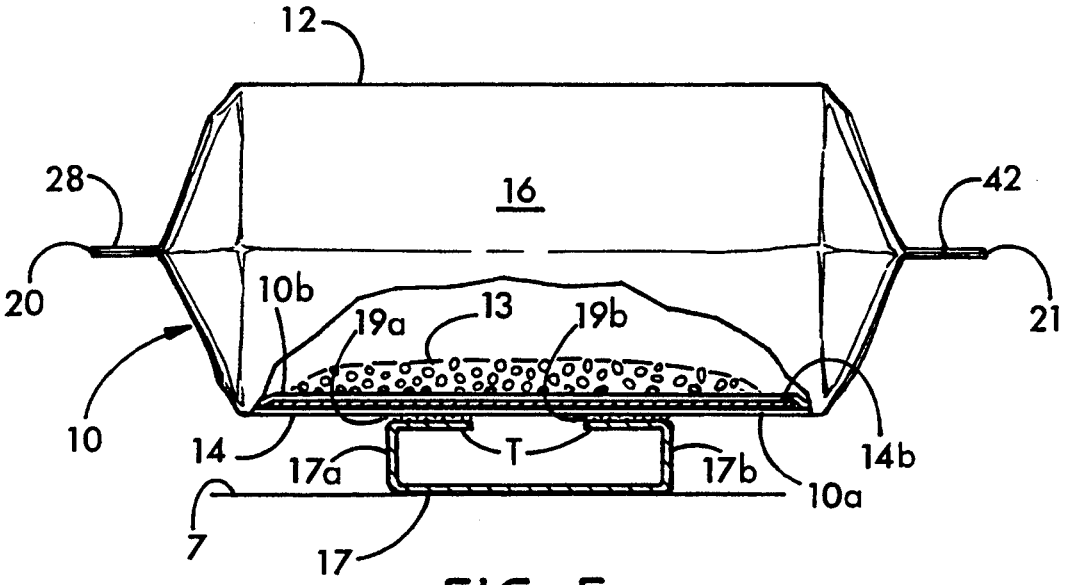
FIG. 5 is a side view of the package after popping.
Figure 6:
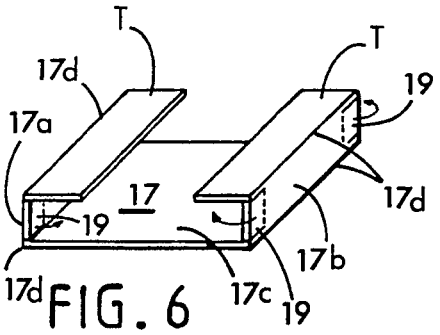
FIG. 6 is a perspective view of the collapsible stand illustrated in FIGS. 4 and 5 as seen before it is bonded to the lower surface of the bag.
Figure 6A:
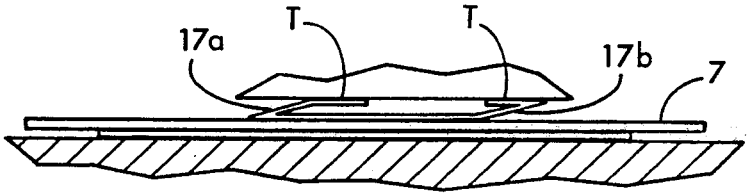
FIG. 6A is a partial side elevational view of the bag with the stand in a partially collapsed position.

Bonded as shown in FIGS. 4, 5 and 6A, e.g., by means of adhesive, to the bottom of the bag 10 is a stand 17 formed, for example, from microwave transparent paperboard having a pair of upright segments 17*a* terminating in centrally folded tabs T which are bonded by being glued to the bottom panel 14 of the bag 10 for supporting the bag at a height of, say, about 2 cm above the turntable 7. It will be noted that the tabs T are relatively small in size compared to the susceptor 14*b*. This will help to avoid overheating of the susceptor 14*b*. The stand 17 in this case includes a central rectangular bottom panel designated by the numeral 17*c* (FIGS. 5 and 6). Fold lines 17*d*, i.e., pre-formed creases in the paperboard, define the intersection between the tabs T, the upright segments 17*a* and 17*b*, and the lower panel 17*c*. Retaining tabs 10 can be folded centrally about vertical fold lines to help hold the stand erect. Because the stand 17 is collapsible, it can be used both in the collapsed position illustrated in FIG. 6A or erected by folding the adjoining panels along the fold line 17*d* to the erect position shown in FIG. 5. Accordingly, the stand 17 can be used to position the bag 10 in at least two alternate positions at different elevations for different applications; namely, by placing the stand 17 in an erect position (FIGS. 4–6) or a collapsed position (FIG. 6A) to suit whatever conditions exist in the particular oven in which the popcorn bag 10 is cooked. The stand 17 can thus be thought of as a collapsible stand suited for positioning the bag 10 at selected positions within the oven, namely, at two or more elevations; one position (when the stand 17 is collapsed) locating the popcorn within the bag 10 very close to the oven supporting surface and the second position (when the stand 17 is erect) locating the bottom wall 17*c* of the bag 10 in a raised position in spaced relationship with the oven supporting surface, e.g., the oven turntable 7, and in this way placing the popcorn as well as the susceptor 14*b* where both will efficiently absorb the microwave energy to pop the corn more completely and evenly. When the stand 17 is folded halfway or to any other intermediate position, it will support the bag 10 at some intermediate position between the raised and lowered position to suit any kind of oven encountered.

The bottom seal B is made very strong in any suitable manner to prevent it from popping open due to internal pressure prior to the top seal A. This can be accomplished by having the bottom seal 42 extend further toward the top of the bag, causing seals 40, 44 to intersect higher up so that the seals become redundant. The seal at the top A of the bag is preferably made somewhat weaker than the bottom seal B to provide a normally closed steam vent that opens at the top responsive to internal steam pressure. The seal A thus opens to provide for the escape of excess steam from the top of the bag during the popping operation.

In a typical example of the invention, the bag is 28 cm long, each face is 13 cm wide, the gussets are 5 cm deep (10 cm across), and the height of the stand 17 is 1.9 cm. Such a bag will have a capacity of 2600 cc and will hold a charge of 100 grams of popcorn and shortening, and replaces a standard rectangular 1600 cc bag that was able to hold a charge of only 50 grams, the largest that could previously be used with a standard 23 cm turntable.

Figure 7:
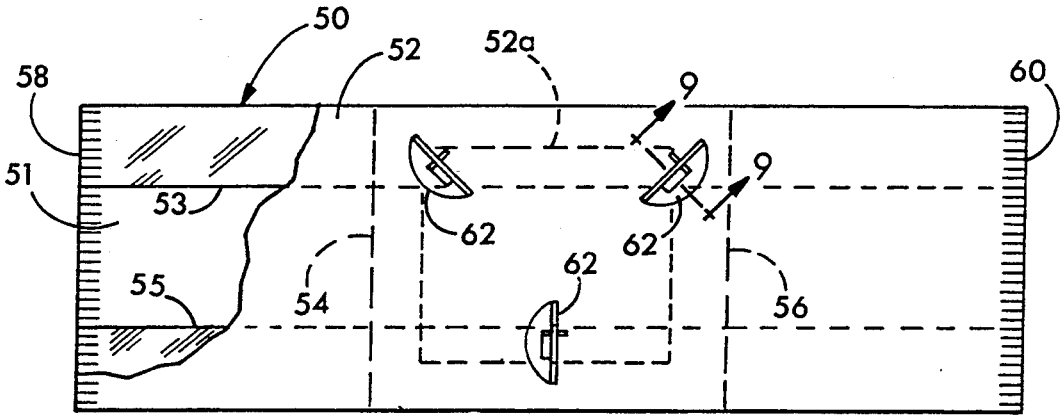
FIG. 7 is a plan view of the lower surface of a popcorn popping bag having another form of collapsible stand.
Figure 8:
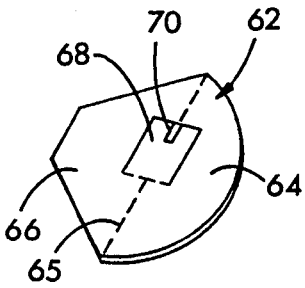
FIG. 8 is a perspective view of one of the legs of the stand shown in FIG. 7.
Figure 9:
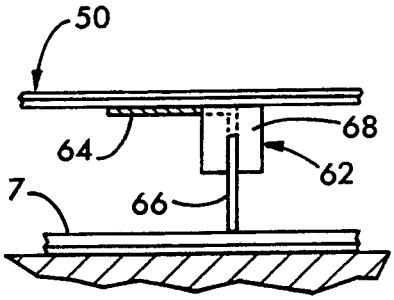
FIG. 9 is a partial vertical sectional view taken on line 9—9 of FIG. 7 on an enlarged scale.
Figure 10:
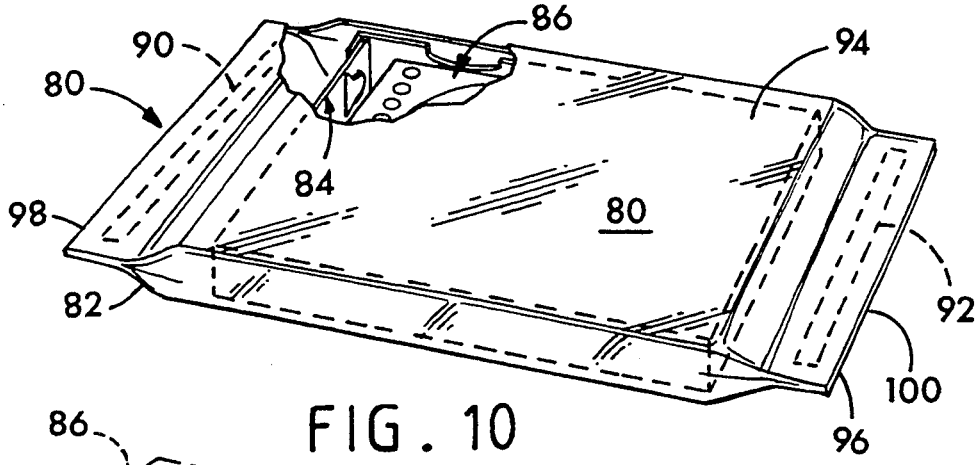
FIG. 10 is a perspective view of another form of package in accordance with the invention.

Refer now to FIGS. 7–9 which illustrate another embodiment of the invention. In this case, the popcorn bag 50 is generally similar to the bag 10 of FIGS. 1–5 except that the ends are cut straight across to provide straight ends 58 and 60 rather than being arcuate or cut with diagonal corners. Thus, the bag 50 includes an upper rectangular panel 51 and a lower panel 52 of the same shape and size. The panels 51, 52 are connected together along the side edges by means of centrally extending gusset folds 53 and 55. In the lower panel 52 is provided any suitable commercially available microwave heating susceptor 52*a* which becomes hot when exposed to microwave energy. The bag 50 is provided with longitudinally spaced apart, laterally extending fold lines 54, 56 that enable the bag to be folded twice to one-third its original size for compact shipment. The ends of the bag 50 are sealed shut all the way across by means of a suitable adhesive providing straight seals adjacent to the straight cut ends 58 and 60.

To the lower panel 52 of the bag 50 is bonded a stand as a part of the bag 50. The stand in this case consists of three foldable legs 62 formed from paperboard or from a sheet of foldable plastic. Each of the legs 62 has a base portion 64 that is bonded to the lower wall 52 of the bag 50 and an adjacent leg portion 66 which is connected to the base 64 by means of a pre-formed crease or fold line 65.

Figure 8B:
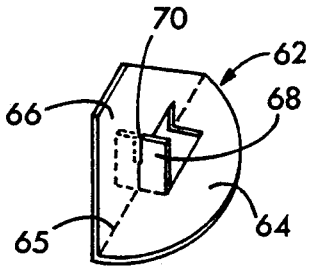
FIG. 8B is a perspective view of the leg of FIG. 8 folded to its erect position.

When the bag 50 is shipped, the legs 62 are in the collapsed condition of FIG. 8. However, when the bag 50 is to be used on turntable 7, the leg portions 66 are folded to the erect position shown in FIGS. 7, 8B and 9, and a centrally located foldable tab 68 is also elevated to an erect position as shown in FIG. 8B so that a slot 70 engages the leg portion 66 to securely hold the leg portion 66 in its erect position. As in the first embodiment, when the legs 62 are collapsed, the bag 50 can be placed in the microwave oven in a lower position, but if the legs 62 are erected, the bag 50 will be raised above the bottom wall of the microwave oven to an elevated position as shown in FIG. 9 so as to substantially increase cooking efficiency by enhancing energy tranfer to the susceptor 52*a* when the oven floor or food support is composed of metal.

Refer now to FIGS. 10–14 which illustrate another form of package 80 in accordance with the invention. The package 80 comprises three main parts: a plastic overwrap 82, a tray-shaped pre-erected stand 84 and a collapsed paper popcorn bag 86 containing a charge 88 composed of popcorn and shortening. The bag 86 is the same as the bag 50 already described hereinabove, and the same numerals refer to corresponding parts. It is also the same as the bag 10 except that the diagonal corner cuts 32, 34, 36 and 38 are not present. Accordingly, the bag 86 has a rectangular outline. Diagonal corner cuts can, however, be provided if desired.

Figure 11:
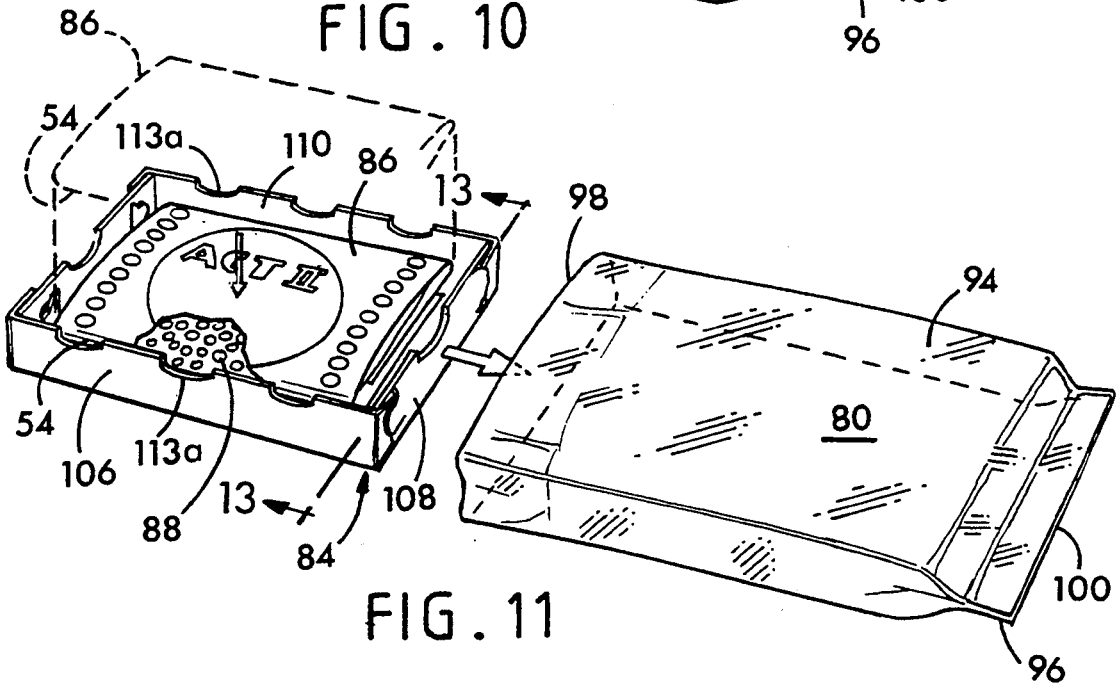
FIG. 11 is an exploded view of the package of FIG. 10 showing how it is assembled.
Figure 12:
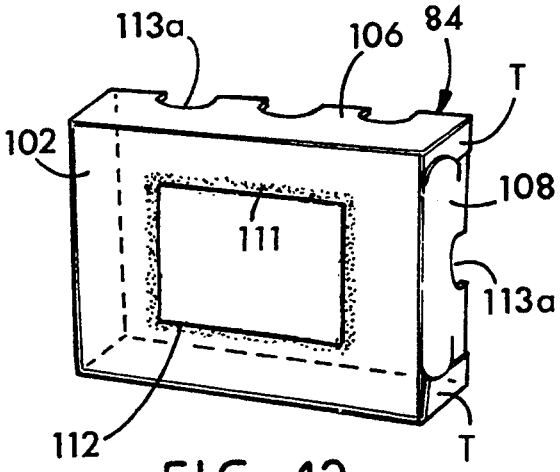
FIG. 12 is a bottom view of the tray-style stand illustrated in FIG. 11.
Figure 13:
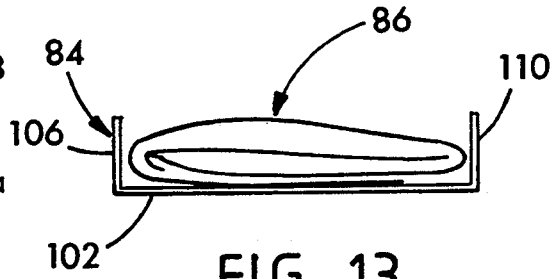
FIG. 13 is a vertical sectional view taken on line 13—13 of FIG. 11.

After being filled with the charge 88 of popcorn and shortening and sealed, the bag 86 is folded along two transversely extending fold lines 54, 56 on either side of the susceptor 52*a* to reduce the bag 86 to one-third of its original size. The stand 84 is made of just the proper size to receive the folded bag 86. This allows the folded bag 86 to be placed inside the stand 84 for compact shipment and storage as shown in FIG. 11.

The overwrap or pouch 82 includes upper and lower opposing walls 94 and 96 which are cut transversely to provide a pair of cut ends 98, 100 that are sealed together along transversely extending seals such as heat seals 90, 92. The overwrap 82 can comprise any suitable paper or plastic material such as oriented polypropylene having a thickness of 118 gauge or 0.0018 inches (30 microns). If desired, the overwrap 82 can be printed with a suitable label and cooking directions or the like. After the stand 84 containing the bag 86 is inserted into the overwrap or pouch 82, the pouch is closed at its ends by means of the heat seals 90, 92.

Figure 14:
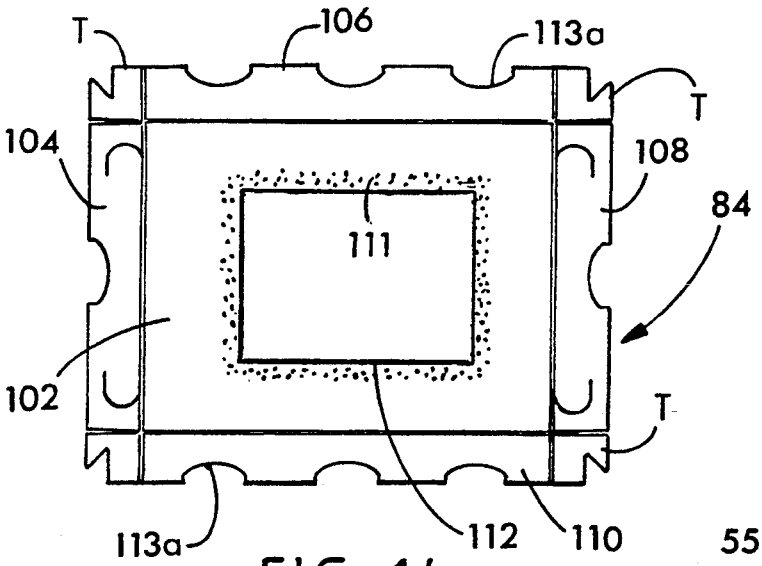
FIG. 14 is a plan view of the blank used to form the stand before being erected.

The stand 84 can be formed from heavy paper or paperboard, but is preferably formed from paperboard such as 16 point (260 micron) paperboard that has a broad horizontally disposed rectangular supporting wall 102 and four low upright side walls 104–110 joined to the supporting wall 102 along fold lines as shown in FIG. 14. The side walls 104–110 terminate in locking tabs T. Optionally, sections of the side walls 104–110 are removed to provide openings at 113*a* adjacent to their lower edges to help hot air escape from beneath the stand 84. The stand 84 is assembled at the factory by folding the side walls 104–110 along the fold lines as shown so that they are positioned at right angles to the supporting wall 102. The tabs T are then bonded or locked to underlying sides of the adjacent side walls 106, 110 so that the stand takes the form of a tray as shown.

The supporting wall 102 is provided with an opening 112 surrounded by a heat-actuated adhesive 111 such as a thermoplastic adhesive. While a variety of thermoplastic packaging adhesives can be used, suitable adhesives include aqueous polyvinyl acetate emulsion adhesives such as an adhesive known as Durocet-12 by Franklin International, Columbus, Ohio or Fuller Adhesive 111 No. 3460 by the Fuller Company of St. Paul, Minn. The aqueous emulsion adhesive is applied around opening 112 as a liquid and allowed to dry, in this case on the surface of the stand 84 near the center portion of the broad supporting wall 102 around opening 112.

The stand 84 is thus initially separate, i.e., detached from the popcorn-containing bag 86, and is shaped like a tray. This allows the bag 86, once folded at 54, 56, to be placed inside the stand 84 for shipment as shown in FIG. 11 so that the stand 84 occupies little additional space. The invention therefore provides a very compact package.

Figure 15:
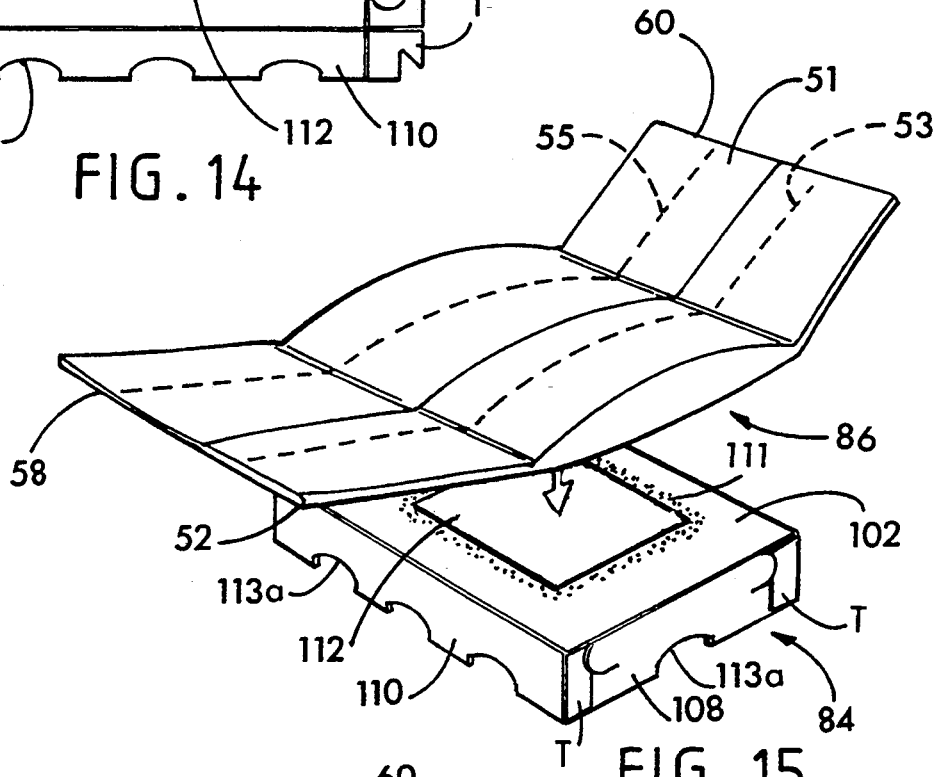
FIG. 15 is a perspective view showing the popcorn bag after it is unfolded and before being mounted upon the stand.
Figure 16:
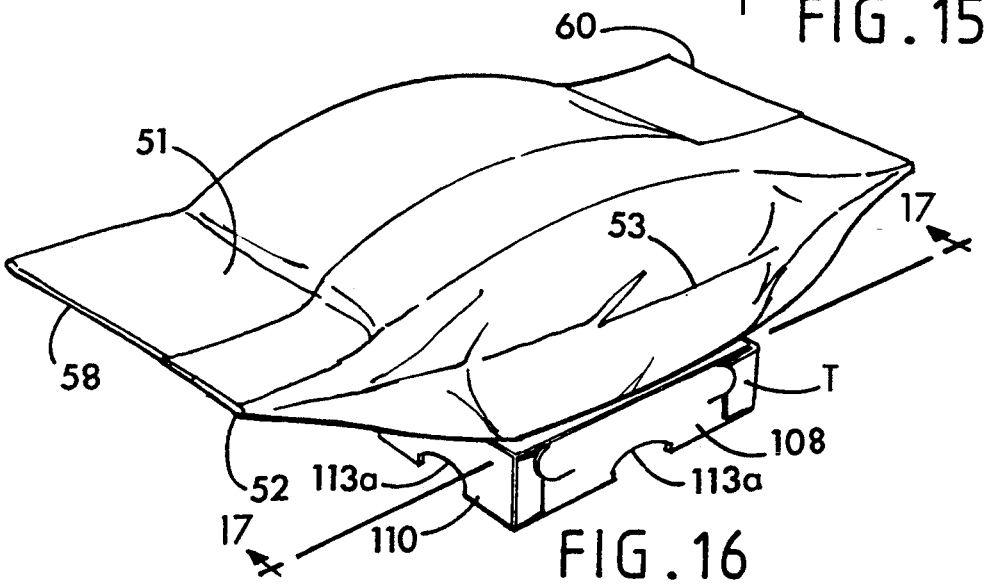
FIG. 16 is a perspective view of the package as it appears during cooking.
Figure 17:
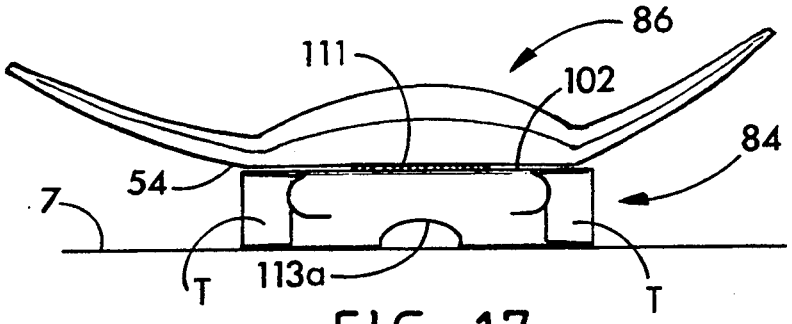
FIG. 17 is a view taken on line 17—17 of FIG. 16 at the beginning of cooking.

When the popcorn is to be popped, the pouch 82 is opened and the stand 84 and bag 86 are removed. The stand 84 is then placed in the microwave oven as shown in FIGS. 15–17 with the broad supporting wall 102 uppermost and the low side walls 104–110 upright. The free edges of the walls 104–110 rest on a horizontal food supporting surface such as the turntable 7 (FIG. 17) within the oven 4 and act as feet for the stand 84. The bag 86 is then unfolded along fold lines 54, 56 and is placed on the stand 84. Accordingly, the adhesive adjacent opening 112 is in contact with the lower panel of bag 86.

It was discovered that almost as soon as the oven is turned on, usually within five seconds, the microwave energy will heat the thermoplastic adhesive 111 enough so that it will melt, forming a bond between the stand 84 and the bag 86 which joins the bag and the stand during the remainder of the cooking cycle while the bag 86 is expanding as shown in FIG. 16 and the charge 88 of popcorn pops within the bag 86. As this takes place, the turntable 7 rotates the bag 86 and stand 84 in the microwave oven 4. The susceptor 52*a* is adjacent to the thermoplastic adhesive 111 and is in heat transfer relationship with it so as to enhance the heating of the adhesive and help assure the formation of a good bond. Because of the bond thus formed, the rotation of the turntable 7 within the oven 4 will not knock the bag 86 off the stand 84 even if the ends of the bag 86 happen to strike the walls or door of the oven 4. As a result, the package 80 will perform reliably in a variety of ovens in case the package 80 is not placed squarely at the center of the oven 4 or turntable 7.

Figure 18:
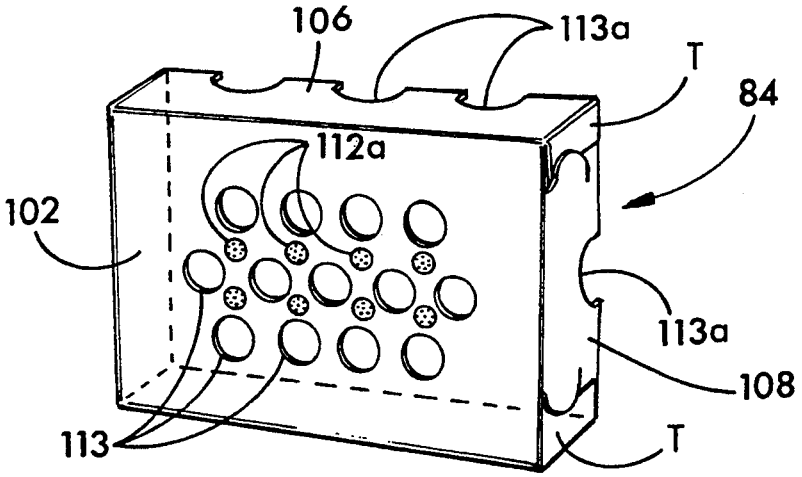
FIG. 18 is a perspective bottom view of another form of stand.

Refer now to FIG. 18. In a modified form of the invention, the adhesive, instead of being applied around one large opening, is applied to the exposed outer surface of the stand 84 as a series of small patches or dots 112*a* interspersed between adjacent openings 113. It is not known exactly why, but the presence of openings 112, 113 or other kinds of openings in the stand 84 provices a discontinuous surface that importantly reduces the tendency of the stand surface to turn brown or scorch during the cooking process.

Figure 19:
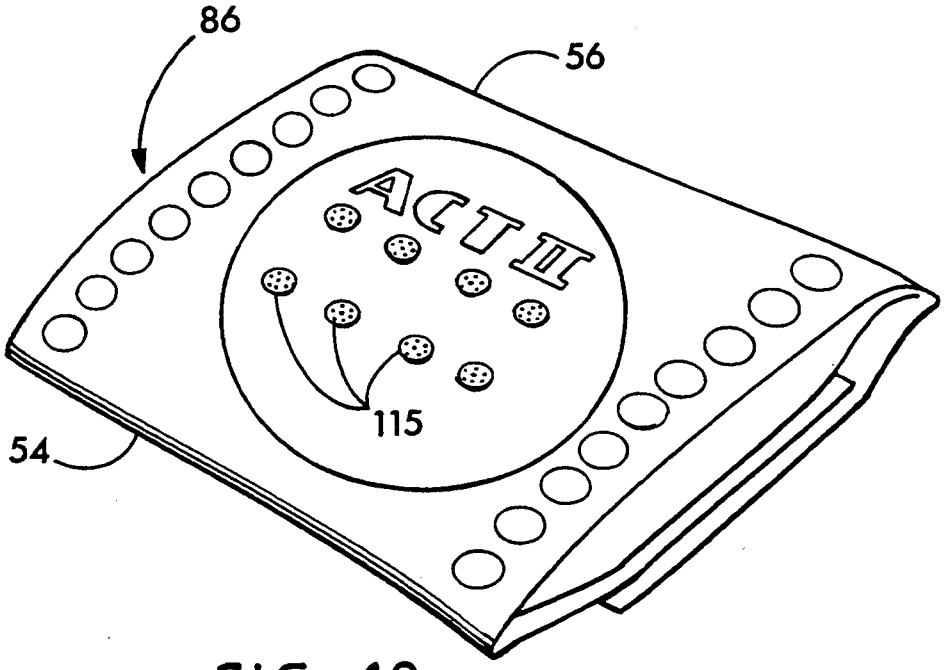
FIG. 19 is a perspective view of another form of popcorn bag.

FIG. 19 shows another modified form of the invention in which the adhesive, instead of being applied to the tray 84, is applied as a series of spaced apart patches of adhesive 115 to the center third of the bag 86 between the fold lines 54, 56. The operation is the same; when the bag 86 is placed on the stand 84 by the user, the thermoplastic adhesive 115 will melt, thereby bonding the stand 84 to the bag 86 during the cooking operation within the microwave oven 4 so as to prevent them from inadvertently coming apart as the cooking operation proceeds. Consequently, the stand 84 is detached but automatically self-attaching to the bag 86.

The forms of the invention illustrated in FIGS. 10–19 are easy to use since the stand 84 does not have to be erected by the user. In addition, the stand 84 occupies very little additional space in the package because the bag 86 can be stored inside the stand 84. Accordingly, the package is very compact, assuring efficient space utilization. Additionally, when the oven is turned on with the bag 86 resting on the stand 84, the bag and stand will almost immediately become bonded together, usually within five seconds, thereby assuring that the bag 86 will not be knocked off the stand 84 as the turntable 7 rotates within the microwave oven 4. The stand 84 also acts somewhat as a hotpad when the package is removed from the oven by helping to keep a person's hands away from the hottest part of the package where the susceptor 52*a* is located. The invention also simplifies disposal since the stand 84 and bag 86 are connected together after the corn 88 has popped.

Commercial Application and Results

The present invention was employed for popping popcorn in four different kinds of microwave ovens. In all of the tests, identical standard commercial production popcorn bags were employed of a type manufactured by the assignee, Golden Valley Microwave Foods, Inc., with a nominal capacity of 3.5 ounces. Some of the bags had stands attached as described herein, and other control bags had no stand.

All of the bags were filled with 71 gms. of corn and 29 gms. of shortening, salt and butter flavoring. The net weight of all bags tested within +/−1.5 gms. of the target weight.

For the invention bags, the top and bottom ends were cut diagonally as shown herein in FIGS. 1–5. The stand employed was glued to the lower surface of each bag below the susceptor, as shown in FIGS. 4 and 5.

The tests involved three runs in each oven. Each run consisted of the control bag with no stand, the invention bag with stand folded flat, i.e., collapsed, and the invention bag with stand erected. The ovens were allowed to cool off between the second and third runs.

The response was the volume of popped corn as measured to the nearest 100 cc., using the same apparatus and technique for every measurement.

The results are summarized in the table below:

TABLE

AVERAGE POPPED VOLUMES (cc)

| Oven Type | Control Bag (no stand) | Invention (Stand folded to collapsed position) | Invention (Stand erected) |
|---|---|---|---|
| Metal Cooking Surface* 600w, small cavity turntable | 2067 | 2100 | 2600 |
| Metal cooking surface* 600w, larger cavity turntable | 1300 | 1900 | 2700 |
| Ceramic cooking surface* 450w, small cavity no turntable | 1750 | 1900 | 1500 |
| Ceramic cooking surface* 655w, larger cavity turntable | 2700 | 2800 | 2500 |

*i.e., surface below bag at floor of oven cavity

It will be seen in the Table that when the bags are placed on a metal cooking surface, erecting the stand will provide a substantial improvement in the volume of popped corn that results. On the other hand, where the ovens have a ceramic cooking surface, maintaining the stand in the collapsed position will result in the greatest volume of popped corn. Consequently, the invention provides a unique capability of maximizing the volume of popped corn in ovens with either a metal or a ceramic floor.

Many variations of the present invention within the scope of the appended claims will be apparent to those skilled in the art once the principles described herein are understood.

What is claimed is:

1. An expandable popcorn package for popping popcorn in a microwave oven comprising, a bag body formed rom flexible microwave transparent sheet material including superimposed upper and lower face panels having parallel left and right side edges with longitudinally extending centrally projecting gussets folded between the upper and lower face panels, a charge of popcorn and shortening contained within the bag, said bag having top and bottom ends with top and bottom seals between the face panels adjacent to the ends of the bag, said seals bonding the upper and lower face panels together and bonding the gussets between the face panels to thereby seal the ends of the bag, said bag being adapted to expand to accommodate the expansion of the popcorn as it pops therein during microwave cooking, a detached and automatically self-attaching stand that is separate from the bag for being placed below the bag to support said bag during cooking of the popcorn in a microwave oven, said stand having a horizontally disposed supporting wall and a plurality of upright side walls at right angles to the supporting wall, said stand rests upon a horizontal food supporting surface within the microwave oven and the bag rests on and in contact with the horizontal supporting wall of the stand during popping of the popcorn, and a heat-activated adhesive between the bag and the horizontal supporting wall of the stand for bonding the bag to the stand in response to heat transferred to said adhesive during microwave cooking of the popcorn within the microwave oven.

2. The package of claim 1 wherein the supporting wall is placed uppermost and the adhesive is a thermoplastic adhesive applied to an outer surface of said supporting wall to be located in contact with the bag during cooking in the microwave oven.

3. The package of claim 1 wherein the adhesive comprises a plurality of patches of adhesive applied to the package between the stand and the bag.

4. The package of claim 1 wherein the adhesive comprises a thermoplastic adhesive and said horizontal supporting wall includes at least one opening for dissipating heat to prevent scorching of the bag.

5. The package of claim 1 wherein said adhesive comprises a plurality of patches of adhesive applied to an outside portion of said bag placed in contact with said stand for bonding the bag to the stand during cooking of the popcorn within the microwave oven.

6. The package of claim 1 wherein the stand is tray-shaped and is dimensioned larger than the bag when the bag is folded to a smaller size for compact shipment and storage within the stand.

7. The package of claim 1 wherein a microwave interactive susceptor is in heat transfer relationship with the adhesive between the bag and the stand for enhancing the formation of an adhesive bond between the stand and the bag.

8. The package of claim 7 wherein the susceptor is in the lower panel of the bag adjacent to the adhesive.

9. The package of claim 1 wherein the stand has at least one opening in the horizontally disposed supporting wall and the adhesive is applied to an outside surface of the supporting wall adjacent to said opening.

10. The package of claim 9 wherein the adhesive surrounds the opening.

11. The package of claim 9 wherein a plurality of said openings are provided in said supporting wall of the stand, and the adhesive is applied to the supporting wall adjacent said openings.

12. The package of claim 11 wherein the adhesive is applied to the supporting wall as patches of adhesive interspersed among said openings.

13. An expandable popcorn package for popping popcorn in a microwave oven comprising, a bag body formed from flexible microwave transparent sheet material including a plurality of panels and portions folded between the panels to permit expansion of the bag, said bag has a hollow interior for receiving a charge of popcorn, said bag having top and bottom ends with sealing means at the top and bottom ends of the bag between portions of the bag adjacent the ends of the bag, said sealing means forms bonds in the bag for closing the ends of the bag, said bag being adapted to expand to accommodate the expansion of the popcorn as it pops therein during microwave cooking, a detached and automatically self-attaching stand that is separate from the bag for being placed below the bag to support said bag during popping of the popcorn in the microwave oven, said stand having a horizontally disposed supporting wall and a plurality of upright side walls at right angles to the supporting wall, said stand rests during use upon a horizontal food supporting surface within the microwave oven and the bag rests on and in contact with the horizontally disposed supporting wall of the stand during popping of the popcorn, a heat-activated adhesive is present between the bag and the horizontally disposed supporting wall of the stand for bonding the bag to the stand in response to heat transferred to said adhesive during microwave popping of the popcorn within the microwave oven.

14. The package of claim 13 wherein the supporting wall of the stand is placed uppermost during popping of the popcorn, the adhesive is a thermoplastic adhesive positioned between the stand and the bag during cooking in the microwave oven, said stand has at least one opening in the horizontally disposed supporting wall and the thermoplastic adhesive is positioned adjacent said opening.

* * * * *